US006334662B2

(12) United States Patent
Hollands

(10) Patent No.: US 6,334,662 B2
(45) **Date of Patent: *Jan. 1, 2002**

(54) METHOD AND APPARATUS FOR CLEANING AN INK JET PRINTHEAD

(75) Inventor: Peter Joseph Hollands, Baarlo (NL)

(73) Assignee: Oce-Technologies B.V., MA Venlo (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,070

(22) Filed: Jan. 19, 1999

(30) Foreign Application Priority Data

Jan. 16, 1998 (EP) ..... 98200115

(51) Int. Cl.[7] ..... B41J 2/165
(52) U.S. Cl. ..... 347/22; 347/35
(58) Field of Search ..... 347/30, 22, 32, 347/33, 27, 35

(56) References Cited

U.S. PATENT DOCUMENTS

| | | | | | |
|---|---|---|---|---|---|
| 4,609,925 | A | * | 9/1986 | Nozu et al. | 347/27 |
| 4,849,769 | A | * | 7/1989 | Dressler | 347/27 |
| 5,128,690 | A | | 7/1992 | Nozawa | |
| 5,298,923 | A | * | 3/1994 | Tokunaga et al. | 347/30 X |
| 5,412,411 | A | * | 5/1995 | Anderson | |
| 5,574,485 | A | | 11/1996 | Anderson et al. | |
| 5,790,146 | A | * | 8/1998 | Anderson | 347/28 |

FOREIGN PATENT DOCUMENTS

| | | | | |
|---|---|---|---|---|
| EP | 6 30755 A2 | | 12/1994 | |
| EP | 6 78389 A1 | | 10/1995 | |
| JP | 62 113555 | | 5/1987 | |
| JP | 5-42678 | * | 2/1993 | 347/22 |

* cited by examiner

*Primary Examiner*—David F. Yockey

(57) ABSTRACT

An ink jet printhead having a nozzle face in which at least one printhead nozzle is formed is cleaned by disposing a suction nozzle in front of the nozzle face, so that it forms a small gap therewith, and sucking ink out of the prinhead nozzle. The ink is caused to spread or flow in the gap in a direction parallel to the nozzle face so as to clean the nozzle face.

10 Claims, 2 Drawing Sheets

METHOD AND APPARATUS FOR CLEANING AN INK JET PRINTHEAD

BACKGROUND OF THE INVENTION

The present invention relates to a method and an apparatus for cleaning an ink jet printhead having a nozzle face in which at least one printhead nozzle is formed.

A typical ink jet printhead comprises a plane nozzle face in which a linear array of individual nozzles are formed. The printhead further comprises means for supplying liquid ink to the nozzles and for generating pressure pulses in the ink liquid, so that ink droplets are expelled from the nozzles. Since the nozzles tend to become clogged with dried ink or foreign matter, it is necessary to clean the nozzles from time to time. Further, the nozzle face surrounding the nozzle orifices opening may become soiled with dust or the like, and this may deteriorate the process of droplet formation and/or influence the direction in which the ink droplets are jetted out. For this reason it is also necessary to clean the nozzle face at least in the vicinity of the nozzles.

U.S. Pat. No. 5,574,485 discloses a cleaning head which is disposed in front of the nozzle face and can be moved along the linear array of nozzles in a cleaning operation. This cleaning head has a suction nozzle facing the printhead with a small gap formed between the end of the suction nozzle and the nozzle face of the printhead. The suction nozzle is connected to a suction device such as a vacuum pump and can be aligned with the individual printhead nozzles. A cleaning liquid is fed to the cleaning head and pumped against the nozzle plate. This cleaning liquid which dissolves the ink is sucked into the suction nozzle in order to scavenge and clean the printhead nozzle.

The cleaning head further has an ultrasonic liquid wiper juxtaposed to the suction nozzle so that it also confronts the nozzle face of the printhead. The wiper is formed by a tubular ultrasonic transducer the front end of which also forms a small gap with the nozzle face. The tubular transducer defines a supply channel through which a cleaning liquid, e.g. a solvent, can be supplied into the gap. The cleaning liquid forms a liquid bridge between the end of the transducer and the nozzle face. This liquid bridge is stabilized in the gap by the surface tension of the liquid and moves together with the transducer when the cleaning head is scanned along the nozzle array, so that the nozzle face is wiped with cleaning liquid. In order to enhance the cleaning effect, the transducer is energized so that ultrasonic waves are created in the liquid bridge.

U.S. Pat. No. 5,412,411 discloses an ink jet printer in which the whole nozzle face of the printhead can be immersed in liquid ink contained in a tank, whereby the ink in the tank is used for capping and cleaning the nozzle face.

SUMMARY OF THE INVENTION

It is an object of the present invention to provide a method and apparatus with which an ink jet printhead can be cleaned easily and efficiently.

According to the present invention, a suction nozzle is disposed in front of the nozzle face, so that it forms a small gap therewith, and ink is sucked out of the nozzle printhead and is caused to spread or flow in said gap in a direction parallel to the nozzle face, wherein pressure waves are generated in the ink volume which forms a liquid bridge (54, 56) between the nozzle face (28) and the suction nozzle (38) by activating the printhead (10) whereby ink is ejected from the printhead nozzles (16) that open into the gap (44).

Thus, according to the present invention, the ink itself is used not only for scavenging the nozzles but also for cleaning the nozzle face. Since the ink serving as cleaning liquid is supplied directly via the printhead nozzles, it is not necessary to provide separate supply means for the cleaning liquid. In addition, the cleaning or scavenging of the nozzles and the cleaning of the nozzle face surrounding the nozzle orifices can be achieved very efficiently in a single operation. The spreading of the ink in the gap is highly promoted by activating only the printhead nozzles that are currently facing the suction nozzle, so that ink droplets are actively ejected into the gap and the ink can accumulate in the gap.

The invention is useful for cleaning all sorts of inkjet systems, whether water based, solvent based or hotmelt ink based. In the latter case cleaning is performed when the ink is in a molten state.

Several effects can be used either alone or in combination for causing the ink supplied via the printhead nozzles to spread in the gap. For example, such spreading can be caused by capillary action which occurs when the gap is made small enough and the wetting angle of the ink with the nozzle face of the printhead on the one hand and the end face of the suction nozzle on the other hand is sufficiently small.

Another way to cause a spreading of the ink is to make the end face surrounding the mouth of the suction nozzle sufficiently large, so that it covers a plurality of printhead nozzles. Then, when air is drawn into the suction nozzle, a low pressure zone is created in the gap between the suction nozzle and the nozzle face of the printhead, so that there is an extra force sucking the ink from a plurality of printhead nozzles at a time which causes the ink to flow through the gap towards the mouth of the suction nozzle.

The suction nozzle may be formed as or combined with a vibrator or ultrasonic transducer for generating pressure fluctuations in the ink contained in the gap, thereby enhancing the cleaning effect.

When the suction nozzle is scanned along the array of printhead nozzles, the ink volume contained in the gap will move together with the suction nozzle so that a stripe shaped portion of the nozzle face containing the nozzles is wiped with ink. When the suction nozzle is moved to an inoperative position, e.g. at one end of the nozzle array where no printhead nozzles are present, and the suction device is still kept operative for some time, the ink will be removed from the gap without remnants.

The method and apparatus described herein are suitable for solvent-based inks, but are also particularly useful for hot-melt ink which is solid at room temperature and is kept at a temperature above its melting point, e.g. at about 100° C., when the printer and/or the cleaning device is operating. The method can also be used to remove air from the printhead.

BRIEF DESCRIPTION OF THE DRAWINGS

Preferred embodiments of the invention will now be described in conjunction with the accompanying drawings, wherein.

DETAILED DESCRIPTION OF THE INVENTION

Figure 1:
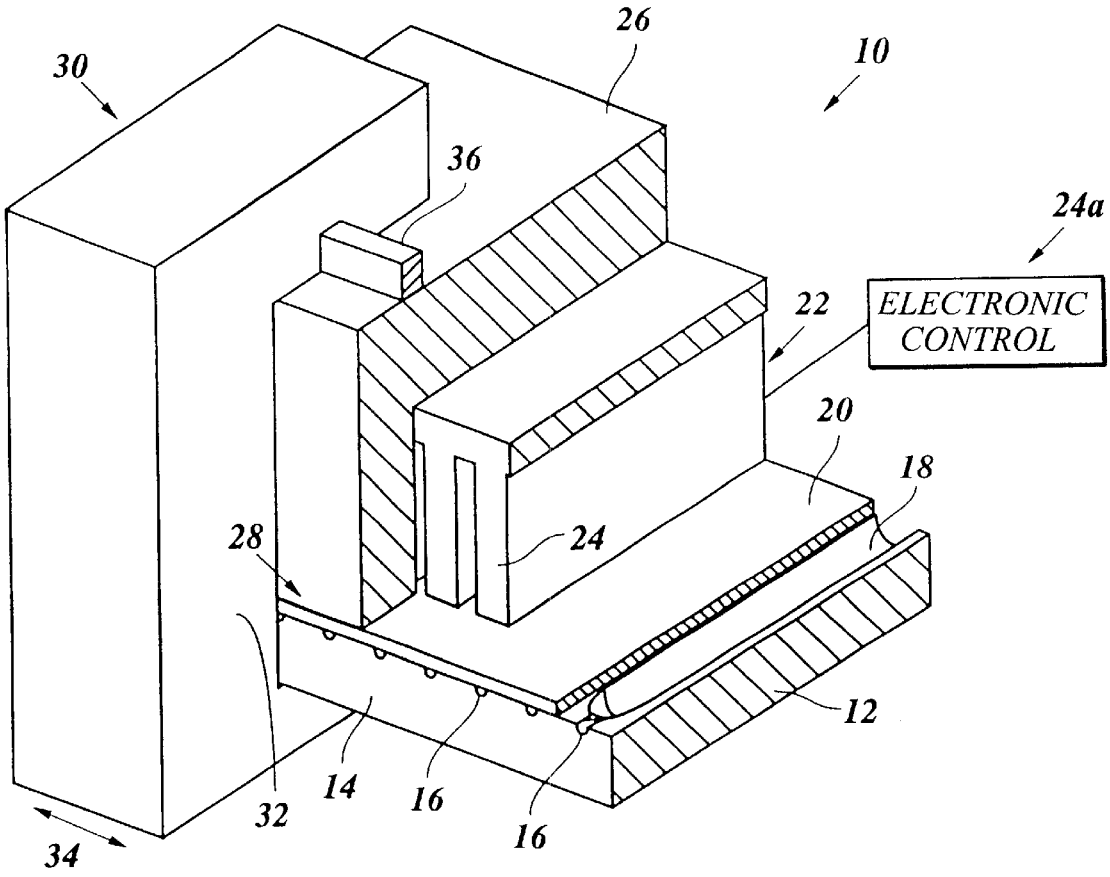
FIG. 1 is a schematic perspective view of an ink jet printhead and a cleaning head with some parts of the printhead broken away for illustration purposes.

As is shown in FIG. 1, an ink jet printhead 10 comprises a channel plate 12 which has a front face 14 formed with a linear array of equidistant nozzles 16. A plurality of ink channels 18 are formed in the top surface of the channel plate 12. These ink channels are arranged in parallel to one another and each channel is connected to a corresponding nozzle 16.

A diaphragm 20 is bonded to the top surface of the channel plate 12 so as to cover the open faces of the ink channels 18 and the nozzles 16.

An actuator member 22 is superimposed on the diaphragm 20 and forms a plurality of piezoelectric actuators 24 which are configured as parallel, substantially downwardly extending fingers, the lower end faces of which are bonded to the diaphragm 20. Each actuator is opposed to one of the ink channels 18.

An enclosure member 26 encapsulates the actuator member 22. Front faces of the enclosure member 26 and the diaphragm 20 are flush with the front face 14 of the channel plate 12, so that a continuous plane nozzle face 28 is formed.

As is generally known in the art and not shown here, a recording paper is movable past the nozzles 16 in a direction perpendicular to the linear array of nozzles, ink supply means are provided for supplying liquid ink to the ink channels 18, and electronic control means 24*a* are provided for selectively energizing the actuators 24, thereby causing the diaphragm 20 to flex and compress the ink volume contained in the ink channels 18, so that ink droplets are expelled from the nozzles 16 and are deposited on the recording paper in accordance with an image to be printed. By way of example it may be assumed that the print head 10 is adapted to operate with hot-melt ink. Accordingly, heating means (not shown) are provided for keeping the temperature of the ink above its melting point.

An ink jet printer may comprise a plurality of printheads 10 arranged with staggered nozzles 16 in order to achieve a high image resolution. The printheads may extend over the whole width of the recording paper.

A carriage 30 incorporates a cleaning head 32 which confronts the nozzle face 28 and the nozzles 16 formed therein. The carriage 30 is movable in the direction indicated by arrows 34 in FIG. 1, so that the cleaning head 32 may scan the array of nozzles 16. During a printing operation the carriage 30 is held in an inoperative position at one end of the printhead 10, outside of the path of transport of the recording paper.

In the shown embodiment the carriage 30 is directly mounted to the printhead 10 and is guided by guide rails 36. Thus, the position of the cleaning head 32 relative to the nozzle face 28 is defined with high accuracy. In an alternative embodiment, the carriage 30 may be mounted on guide means which are separate from the printhead 10. It is also possible to move the carriage in a direction perpendicular on the direction of the arrows 34 to clean all the nozzles simultaneously.

Figure 2:
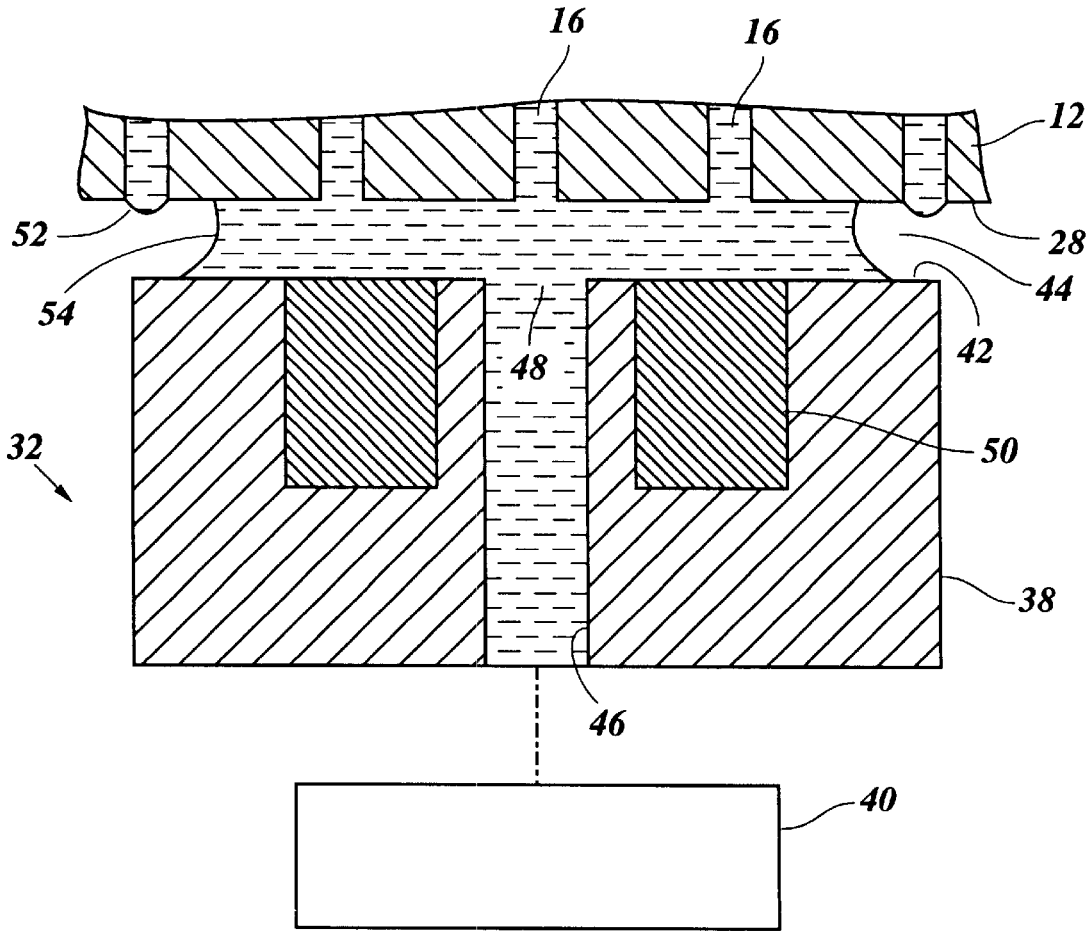
FIG. 2 is an enlarged partial cross-section illustrating a mode of operation of the cleaning head.

FIG. 2 is a simplified cross-sectional view of the cleaning head 32 and a portion of the channel plate 12 adjacent to the nozzle face 28, the section being taken in the plane defined by the nozzles 16.

The cleaning head 32 comprises a suction nozzle 38 connected to a suction device 40. The suction nozzle 38 has a comparatively extended end face 42 held in parallel with the nozzle face 28 so that a narrow gap 44 is formed between the nozzle face and the suction nozzle. The suction nozzle 38 defines a channel 46 one end of which is connected to the suction device 40 while the other end defines a mouth 48 in the end face 42. The width of the mouth 48 is smaller than the distance between two adjacent nozzles 16, whereas the end face 42 as a whole extends over a plurality of nozzles 16. The channel 46 is surrounded by a tubular piezoelectric vibrator 50 or, alternatively, by two vibrators disposed on either side of the channel 46 in the direction of the array of nozzles.

Due to the static pressure of the ink in the ink supply system, the ink contained in the nozzles 16 is subject to a force which tends to press the ink out of the nozzles. This force, however, is counterbalanced by the surface tension of the ink, so that a bulging meniscus 52 is formed at the nozzle orifices.

When the suction device 40 is operated, at first, air is drawn in through the mouth 48 of the suction nozzle. Since the flow of air is restricted in the narrow gap 44, the static and dynamic pressure of the air in the gap 44 is lowered, so that ink is sucked out of the nozzles 16. More specifically, ink is sucked not only from the nozzle which is directly opposed to the mouth 48 but also from the other nozzles which open into the gap 44 defined by the end face 42 of the suction nozzle. Thus, the ink sucked from the nozzles which are offset from the mouth 48 is caused to flow through the gap towards the mouth 48. As a result, an ink volume or a liquid bridge 54 is formed in the gap 44. The ink flowing through the nozzles 16 and the gap 44 is effective not only in cleaning the nozzles 16 but also in cleaning the portions of the nozzle face 28 surrounding these nozzles. In case one of the nozzles shows a higher resistance for ink e.g. caused by clogging of the ink in one of the nozzles, the above system will not work effectively. According to the present invention in case of cleaning, the nozzles are activated to make sure that even clogged ink is forced out of the nozzles.

The nozzle face 28 is made of or coated with a material which is not wetted by the ink. Nevertheless, the wetting angle between the ink and the nozzle face is normally smaller than 90°, typically in the order of 70°, so that the ink is subject to capillary forces which tend to enlarge and stabilize the liquid bridge 54. In the shown embodiment the end face 42 of the suction nozzle 38 consists of or is coated with a material which forms a smaller wetting angle with the ink, so that the capillary forces are increased.

When the suction pressure generated by the suction device 40 is low, the liquid bridge 54 may spread over the whole surface of the end face 42 of the suction nozzle. When the suction pressure is larger, it tends to contract the liquid bridge 54 until an equilibrium state is reached in which the flow of ink through the total of the nozzles 16 is equal to the flow of ink through the channel 46.

The vibrator 50 communicates with the liquid bridge 54 and generates supersonic waves in the ink, thereby enhancing the cleaning effect.

As described above, according to the present invention the actuators 24 associated with the nozzles 16 from which the ink is sucked are energized. This will not only increase the flow of ink but will also produce pressure waves contributing to the cleaning effect, in particular within the nozzles. It is also possible to create an extra ink flow by increasing the overall pressure in the ink supply system.

When the carriage 30 is driven to move the suction nozzle 32 along the nozzle face 28, the capillary forces and suction forces will cause the liquid bridge 54 to move together with the suction nozzle 38, so that the liquid bridge 54 wipes the nozzle face 28 over the whole length of the nozzle array.

Figure 3:
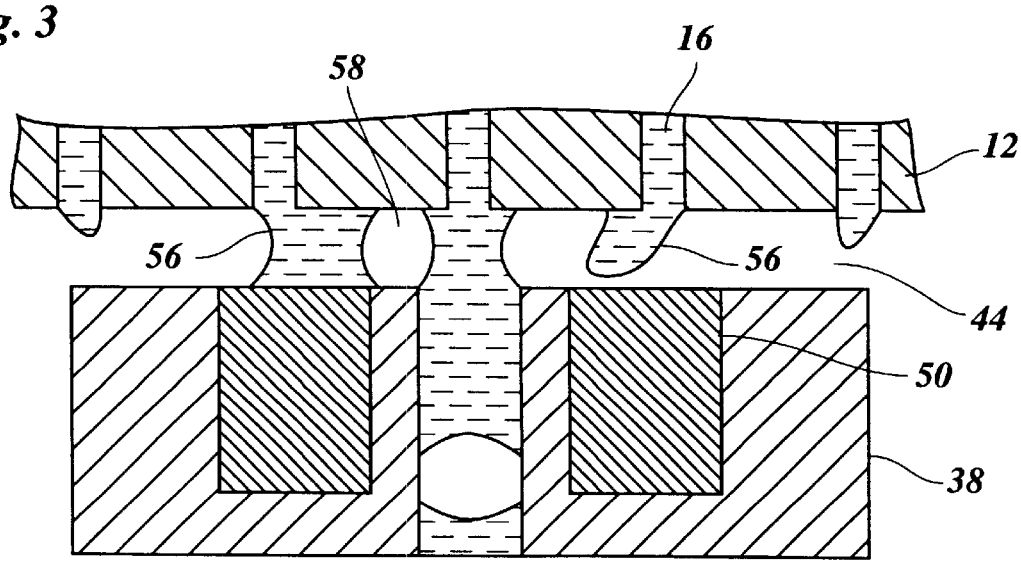
FIG. 3 is a cross-sectional view corresponding to FIG. 2 but illustrating a modified mode of operation.

When the suction pressure is increased further, the capillary forces may no longer be sufficient to stabilize the liquid bridge 54, and air may be drawn in especially from the zones above and below the linear array of nozzles, i.e. from above and below the plane of the drawing in FIG. 2. In this mode of operation, which is illustrated in FIG. 3, the liquid bridge breaks down into a number of separate slugs 56 with bubbles 58 of air intervening therebetween. Since, in this case, the pressure gradient in the gap 44 is large, the ink will nevertheless be efficiently sucked out of all the nozzles 16 which open into this gap, and the slugs 56 will be rapidly accelerated towards the mouth 48 of the suction nozzle so that a high mechanical cleaning effect is achieved.

The ink flowing out through the channel 46 is separated from the air by known techniques and may be discarded or filtered and re-used.

While specific embodiments of the present invention have been described herein, it will occur to a person skilled in the art that various modifications can be made within the scope of the appended claims.

What is claimed is:

1. A method of cleaning an ink jet printhead having a nozzle face in which at least one printhead nozzle is formed, comprising the steps of positioning a cleaning head containing a suction nozzle in front of the nozzle face, so that it forms a small gap therewith, and drawing ink out of the printhead nozzle, whereby the ink is caused to spread or flow in said gap in a direction parallel to the nozzle face, wherein pressure waves are generated in an ink volume which forms a liquid bridge between the nozzle face and the suction nozzle by activating the printhead so that ink is ejected from the at least one printhead nozzle that opens into the gap wherein the ink drawn out of the printhead nozzle is used for scavenging the nozzle and for cleaning the nozzle face.

2. The method according to claim 1, wherein the suction nozzle is scanned over the nozzle face.

3. The method according to claim 1, wherein spreading of the ink in the gap is caused or promoted by capillary action in this gap.

4. The method of claim 3, wherein the ink is drawn out of the printhead nozzle by a suction nozzle which is moved along the nozzle face, and capillary forces and suction forces cause the liquid bridge to move together with the suction nozzle so that the liquid bridge wipes the nozzles over a whole length of the nozzle face.

5.The method according to claim 1, for cleaning a printhead having a plurality of printhead nozzles, wherein ink is sucked from a plurality of printhead nozzles at one time.

6. The method of claim 1, wherein the cleaning head is provided with a vibration source which communicates with the liquid bridge and generates supersonic waves in the ink, thereby enhancing the cleaning effect.

7. The method of claim 1, wherein the overall pressure on the ink is volume is increased to create extra ink flow.

8. An apparatus for cleaning an ink jet printhead having a nozzle face in which a plurality of printhead nozzles are formed, said apparatus comprising a cleaning head containing a suction nozzle positioned in front of the nozzle face, such that it forms a small gap therewith, and a suction device operatively associated with the suction nozzle for drawing ink out of the printhead nozzles through said suction nozzle, said suction nozzle having an end face which extends over a plurality of printhead nozzles in parallel with the nozzle face, said end face further comprising means for activating only the printhead nozzles that open into said gap for supplying ink droplets into said gap, wherein the ink drawn out of the printhead nozzle is used for scavenging the nozzle and for cleaning the nozzle face.

9. The apparatus according to claims 8, wherein a vibrator is in operative association with the suction nozzle for generating pressure waves in ink contained in the gap.

10. The apparatus of claim 8, wherein means is provided for moving the cleaning head containing the suction nozzle along the nozzle face, wherein capillary forces and suction forces cause the formation of a liquid bridge in said gap which moves together with the suction nozzle so that the liquid bridge wipes the nozzle face over the whole length of the nozzle.

* * * * *